US005610570A

United States Patent [19]

Yamada et al.

[11] Patent Number: 5,610,570

[45] Date of Patent: Mar. 11, 1997

[54] VOLTAGE NON-LINEAR RESISTOR AND FABRICATING METHOD THEREOF

[75] Inventors: Seiich Yamada, Juuou-machi; Shigeru Tanaka, Hitachi; Moritaka Syouji, Hitachi; Shigehisa Motowaki, Hitachi; Ken Takahashi, Tokai-mura; Shingo Shirakawa; Kunihiro Maeda, both of Hitachi, all of Japan

[73] Assignee: Hitachi, Ltd., Tokyo, Japan

[21] Appl. No.: 547,793

[22] Filed: Oct. 25, 1995

[30] Foreign Application Priority Data

Oct. 28, 1994 [JP] Japan ..... 6-264847

[51] Int. Cl.[6] ..... H01C 7/10

[52] U.S. Cl. ..... 338/20; 338/21; 361/128; 29/610.1; 252/519

[58] Field of Search ..... 338/21, 20, 26, 338/13; 361/128, 126, 127; 252/519, 518, 521; 29/610.1, 617, 620; 501/126

[56] References Cited

U.S. PATENT DOCUMENTS

| | | | |
|---|---|---|---|
| 4,262,318 | 4/1981 | Shirakawa et al. . | |
| 4,319,215 | 3/1982 | Yamazaki et al. . | |
| 4,326,187 | 4/1982 | Miyoshi et al. | 338/21 |
| 4,335,417 | 6/1982 | Sakshaug et al. | 361/127 |
| 4,477,793 | 10/1984 | Mukae et al. | 338/21 |
| 4,906,964 | 3/1990 | Imai et al. | 338/21 |
| 5,000,876 | 3/1991 | Nemoto et al. | 252/518 |
| 5,039,971 | 8/1991 | Imai et al. | 338/21 |

FOREIGN PATENT DOCUMENTS

| | | |
|---|---|---|
| 2907985 | 9/1979 | Germany . |
| 3026200 | 1/1981 | Germany . |
| 54-101399 | 8/1979 | Japan . |
| 54-26710 | 9/1979 | Japan . |
| 55-98802 | 7/1980 | Japan . |
| 58-27643 | 6/1983 | Japan . |
| 60-31207 | 2/1985 | Japan . |
| 64-30204 | 2/1989 | Japan . |
| 1-309303 | 12/1989 | Japan . |
| 2-58807 | 2/1990 | Japan . |
| 5-275211 | 10/1993 | Japan . |

*Primary Examiner*—Tu Hoang

*Attorney, Agent, or Firm*—Fay, Sharpe, Beall, Fagan, Minnich & McKee

[57] ABSTRACT

A non-linear resistor having a high impulse withstanding ability is obtained by directly applying a crystallized glass to the side surface of a sintered body of a ZnO element, and then bake-attaching the crystallized glass to the side surface of the ZnO element by heat treatment. Since the impulse withstanding ability is improved by applying the crystallized glass as the side surface high-resistivity layer of the voltage non-linear resistor, the performance and reliability of an arrester including the resistor is improved.

10 Claims, 2 Drawing Sheets

VOLTAGE NON-LINEAR RESISTOR AND FABRICATING METHOD THEREOF

BACKGROUND OF THE INVENTION

The present invention relates to a voltage non-linear resistor and method of fabricating voltage non-linear resistor made of ZnO as the main component mainly used in a electric power field such as a transmission/transforming system.

Since the voltage non-linear resistor made of ZnO as the major constituent (hereinafter referred to as a "ZnO element") has excellent non-linear current/voltage characteristics, it has been widely used as an arrester element in a transmission/transforming system. The voltage non-linear resistor is formed of the main component of ZnO containing Bi oxide as a main additive and small amounts of oxides of Sb, Mn, Co, Cr, Si, Ni, Al, B as sub-additives through a common ceramic fabrication technology. The common ceramic fabricating technology here means processes of mixing, calcining and granulating of raw material powder, compacting the powder to form the powder in a proper shape such as a disk, plate, cylinder or torus, baking and heat-treating the compacted body to form a sintered body, then forming electrodes.

The voltage non-linear resistor for electric power use fabricated through the above precesses is required to have various important characteristics such as a high non-linear coefficient ($\alpha$-value), optimization of limiting voltage (varistor voltage), increase of impulse withstanding ability, improvement of loading life time and so on. The most important characteristic among them is that current does not short-circuit to flow along the side surface of the ZnO element when an impulsive high voltage such as a thunder surge, switching surge or the like is applied to the ZnO element (prevention of creeping short-circuit).

In order to cope with this requirement, there are proposed some methods for preventing the creeping short-circuit current flow along the surface of the ZnO element by forming an inorganic high resistance layer having a resistivity higher than that of the ZnO element itself on the side surface of the ZnO element through applying and bake-attaching processes. Typical examples of the inorganic high resistance layers are made of boron silicate zinc glass and aluminum silicate glass as disclosed in Japanese Patent Publication No. 54-26710 (1979) and Japanese Patent Publication No. 58-27643 (1983).

Prevention of creepage short-circuit of a ZnO element maintain the stability of an arrester using the ZnO element, which leads to improvement of reliability and safety of the transmission/transforming system itself.

The voltage non-linear resistors of the prior art described above have the following disadvantages from the viewpoint of prevention of the creepage short-circuit. In a case of forming a boron silicate zinc glass layer, the non-linear coefficient for the ZnO element is decreased. Further, since the acid-resistivity of the glass is low, there is a disadvantage in that the creepage short-circuit resistivity is decreased due to corrosion of the glass by nitric acid gas produced by corona discharge when the ZnO element is used by being contained in a nitrogen atmosphere as in an arrester. Furthermore, in a case of aluminum silicate glass which is proposed to eliminate the above disadvantages, according to the inventors' experiment result using the glass having the same chemical composition and the same component ratios as disclosed, wetness between the ZnO element and the glass itself is worse. Thereby, there is a problem of decrease in the creepage short-circuit resistivity because micro-cracks occur from the interface between the element and the glass layer during the fabricating process and during use as an arrester to cause separation of the glass layer as a result.

SUMMARY OF THE INVENTION

In order to prevent creepage short-circuit of a ZnO element to keep the stability and reliability of an arrester, a better side surface high-resistivity layer and its fabricating method are required. An object of the present invention is, in regard to creepage short-circuit resistivity of an arrester, to provide a voltage nonlinear resistor preventing creepage short-circuit of ZnO element and a method of fabricating the voltage nonlinear resistor.

The factors required for the side surface high-resistivity layer to prevent creepage short-circuit of the ZnO element are as follows:

(1) tight attaching ability with the ZnO element, (2) low non-uniformity in resistivity distribution inside the material, and (3) no impairment of the characteristics of the ZnO element by the heat treatment process for forming the side surface high-resistivity layer.

These are considered to be important.

Crystallized glass is employed for the side surface high-resistivity layer as the result of study of the thermal expansion characteristic, acid resistant ability and so on from the viewpoint of the above items. Further, as the result of study on attaching ability with the ZnO element, it has been found that wetness with the ZnO element is improved by adding ZnO and alkaline earth metals together to the glass and a reaction layer is formed in the interface. As the result of a detailed study on the components of glass, it has been clarified that a crystallized glass composed of ZnO, $Al_2O_3$, $SiO_2$, $ZnO_2$, BaO, and CaO as major components is suitable for the side surface high-resistivity layer. Further, study on the condition of heat treatment based on the above results has led to the present invention.

The present invention is a voltage non-linear resistor (ZnO element) having a crystallized glass containing essential components of $Al_2O_3$, $SiO_2$, ZnO, BaO, $ZnO_2$, CaO as the side surface high resistivity layer.

The ranges of composition in an oxide base are preferably 10~20 wt. % ZnO, 10~30 wt. % $Al_2O_3$, 20~40 wt. % $SiO_2$, 20~30 wt. % BaO, 1.5~5 wt. % $ZnO_2$, 0.5~1.0 wt. % CaO. It is preferable that the $Al_2O_3$ is a filler.

The fabricating method comprises a process in which, in order to obtain a ZnO element, the powder is sintered through a common ceramic fabrication technology, the sintered body cooled down below 300° C., the glass powder in a paste state applied to the side surface of the sintered body, and the sintered body heated up to 800°~950° C. in the atmosphere and kept in that state for longer than one hour.

As described above, a crystallized glass without impairment of the non-linearity of the ZnO element itself and with better acid resistant ability is basically used for the side surface high-resistivity layer. The major components of the crystallized glass are ZnO, BaO, $SiO_2$, $Al_2O_3$, $ZnO_2$, and CaO. The wetness and the attaching ability between the ZnO element and the glass are improved with ZnO and BaO in the glass. Improvement of the effect does not appear when only ZnO is added, or when alkaline earth oxide metal other than BaO is added. By adding ZnO and BaO together, a reaction layer with the ZnO element is easily formed, and the effect of improvement in attaching ability appears. Since CaO reacts with ZnO element inside more deeply than BaO, $SiO_2$, $Al_2O_3$, $ZnO_2$, there is an effect to lessen a step in resistivity distribution between the glass reaction layer of a high resistivity layer and the ZnO element.

As a result, the electric field does not concentrate at cracks or voids in the interface, and the non-uniform resistance distribution in the ZnO element is lowered to decrease occurrence of the creepage short-circuit.

The glass used for the side surface high-resistivity layer according to the present invention is turned into a crystallized glass by performing heat treatment. The compositions of the glass are preferably 10~20 wt. % ZnO, 10~30 wt. % $Al_2O_3$, 20~40 wt. % $SiO_2$, 20~30 wt. % BaO, 1.5~5 wt. % $ZnO_2$, and 0.5~1.0 wt. % CaO.

When $SiO_2$ is more than 40 wt. %, it is unfavorable because the softening temperature, or temperature for working, becomes so high that the baking temperature of the glass is higher than the sintering temperature of the ZnO element. On the contrary, when $SiO_2$ is less than 20 wt. % or $Al_2O_3$ is more than 30 wt. %, it is unfavorable because a lot of cracks occur inside the glass layer and, accordingly, the glass cannot play a role as the high resistively layer. When $Al_2O_3$ is less than 10 wt. %, it is unfavorable because the softening temperature of the glass becomes high. When ZnO is less than 10 wt. %, the thermal expansion coefficient of the glass does not match with that of the ZnO element (ZnO element: $50\sim70\times10^7$/°C.) and, accordingly, a problem is caused in that the glass layer is separated in the fabricating process. On the contrary, when ZnO is more than 20 wt. %, it is unfavorable because the acid resistant ability and the baking temperature of the glass are decreased. When BaO is less than 20 wt. %, there is no effect of improving wetness with the ZnO element. When BaO exceeds 30 wt. %, it is unfavorable because a non-uniform chemical reaction occurs during the heat treating process to cause a non-uniform resistance distribution inside the glass reaction layer. When $ZnO_2$ is less than 1.5 wt. % or more than 5 wt. %, it is unfavorable because the thermal expansion coefficient does not match with that of the ZnO element. When CaO is less than 0.5 wt. % or more than 1.0 wt. %, it is unfavorable because non-uniform resistivity distribution occurs between the glass layer and the ZnO element.

The glass composition according to the present invention may contain SrO, MgO, CoO, $B_2O_3$, CuO, $Y_2O_3$, $MnO_2$, $Na_2O$, $Li_2O$ as impurity. However, the total amount of these components is preferably less than 1 wt. % since the characteristic of the glass is changed when the containing amount is too large.

When the added $Al_2O_3$ is a filler, it is possible to lower the softening temperature, to improve strengthen of glass and to obtain a glass having better crystallization, which meets with the object of the present invention.

The voltage non-linear resistor according to the present invention can be obtained by applying the aforementioned glass powder formed in a paste state by adding a proper organic material to the side surface of a disk-shaped, cylindrical or toroidal ZnO element fabricated through a common ceramic fabrication technology with spray method, dip method or mechanical transfer method, and after drying heating up the sintered body to 800°~950° C. in the atmosphere and keeping the state for longer than one hour. Finally, Al electrodes are formed on the upper and lower end surfaces of the sintered body through a melt spray method or a bake-attaching method. The reason to limit the heat treating temperature is as follows.

When the heat treating temperature is lower than 800° C., the glass does not melt. When the heat treating temperature is higher than 950° C., it is unfavorable because thermal strain is apt to remain in the ZnO element and micro-cracks occur in the interface of the reaction layer and in the glass due to change in the quantity of the glass reaction layer and excessive crystallization. It is preferable to keep the sintered body at the baking temperature for more than 1 hour. When the keeping time is shorter than 1 hour, it is unfavorable from the viewpoint of attaching ability because the reaction does not progress sufficiently. In this fabricating process, it is possible to apply such a heat treatment condition as disclosed by the inventors (Japanese Patent Application No. 6-16080) to improve the characteristic of ZnO element itself (performing heat treatment twice). This does not degrade the effect of the present invention.

It is also possible to provide a high-resistivity ceramic layer (for example, complex oxide material of $Bi_2O_3$, $SiO_2$, $Sb_2O_3$ and the like)in the interface between the ZnO element and the glass layer. This does not degrade the effect of the present invention.

DESCRIPTION OF EMBODIMENTS

Embodiment 1

A starting raw material is prepared by weighing specified amounts of powders as to become the ratio of ZnO having a purity above 99.9% of 94.39 mol. %, $Bi_2O_3$ of 1.0 mol. %, $Sb_2O_3$ of 1.0 mol. %, $MnCO_3$ of 0.5 mol. %, $Co_2O_3$ of 1.0 mol. %, $Cr_2O_3$ of 1.0 mol. %, NiO of 1.0 mol. %, $B_2O_3$ of 0.1 mol. % and Al $(NO_3)_3$ of 0.01 mol. %, mixing the powders excluding ZnO using a pearl-mill, after drying calcining the mixed powder in air at 850° C. for 2 hours, then crushing the calcined material to produce a complex oxide material, adding a proper amount of polyvinyl alcohol to the specified amounts of the complex oxide material and the ZnO powder, and mixing the powders using a ball-mill to produce a granulated powder.

After press-compacting the granulated powder, the compacted body is sintered in air at 1190° C. for approximately 4 hours. The rising and falling rates of temperature at that time are approximately 70° C./h. The dimension of the ZnO element after sintering is $\phi50\times25$ t.

Figure 1:
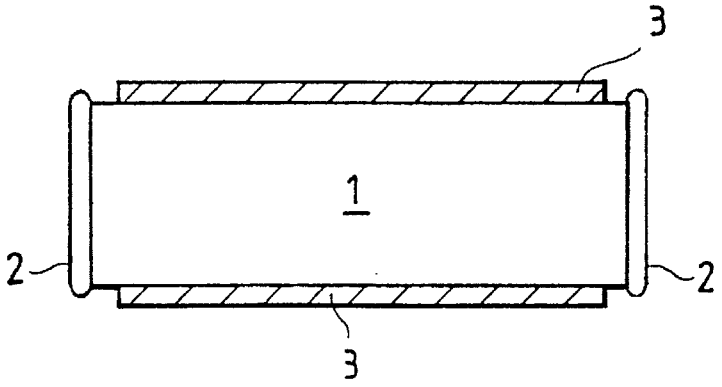
FIG. 1 is a cross-sectional view explaining a ZnO element in accordance with the present invention.

On the other hand, powder of glass (softening temperature: 850° C., composition: ZnO=15 wt. %, BaO=27 wt. %, $Al_2O_3$ filler=25 wt. %, $SiO_2$=29.2 wt. %, $ZnO_2$=3 wt. %, CaO=0.8 wt. %) is suspended in carbithol solution of ethyl cellulose to form in a paste state, and the paste-state material is applied to the side surface of the above sintered body through a spray method so that the thickness becomes 100~200 μm and then dried. The sintered body is heated up to 850° C. and kept for 2 hours, and then cooled down to room temperature at cooling rate of approximately 75° C./h. Electrodes are formed by melt-spraying Al on the top and bottom end surfaces of the sintered body obtained to fabricate a ZnO element. It is confirmed that the bake-attached glass is crystallized. FIG. 1 is a schematic cross-sectional view showing the fabricated ZnO element, wherein reference number 1, 2 and 3 represent the ZnO element, glass layers and Al electrodes, respectively.

Table 1 shows a result of the non-linear coefficient (α-value) and the impulse withstanding ability of the fabricated ZnO element.

TABLE 1

| | NON-LINEAR COEFFICIENT | IMPULSE WITHSTANDING ABILITY | | | |
|---|---|---|---|---|---|
| | (α) | 40 kA | 60 kA | 80 kA | 100 kA |
| PRESENT INVENTION | 25~30 | o | o | o | o |
| CONVENTIONAL 1 (BORON SILICATE ZINC GLASS) | 5~10 | o | x | x | x |
| CONVENTIONAL 2 (ALUMINUM SILICATE GLASS) | 15~20 | o | x | x | x |

The non-linear coefficient (α-value) is obtained by Equation (1) using $V_1$ and $V_2$ which are voltages between the ZnO element when DC 10 μA($I_1$) and 1 mA($I_2$) current flow to the ZnO element.

$$\alpha\beta\{\log(I_1/I_2)\}/\{\log(V_1/V_2)\} \quad (1)$$

The impulse withstanding ability is evaluated by the presence or absence of damage (creepage short-circuit) of the ZnO element when an impulse current of 8×20 μs (four kinds of current) is conducted twice. In the table, the mark o indicates a normal case and the mark x indicates a damaged case.

The non-linear coefficient of the ZnO element according to the present invention is nearly twice as large as that of the conventional element, on the side surface of which boron silicate zinc glass (conventional 1 in the table) or aluminum silicate glass (conventional 2) is bake-attached on. As for the impulse withstanding ability, the conventional elements are damaged at 40 kA. On the other hand, the element according to the present invention is in a normal condition up to 100 kA.

Embodiment 2

Similar to the embodiment 1, a starting raw material is prepared by weighing specified amounts of powders to achieve the ratio of ZnO having a purity above 99.9% of 94.39 mol %, $Bi_2O_3$of 1.0 mol %, $Sb_2O_3$ of 1.0 mol %, $MnCO_3$ of 0.5 mol. %, $Co_2O_3$ of 1.0 mol. %, $Cr_2O_3$ of 1.0 mol. %, NiO of 1.0 mol. %, $B_2O_3$ of 0.1 mol. % and $Al(NO_3)_3$ of 0.01 mol. %, mixing the powders excluding ZnO using a pearl-mill, after drying calcining the mixed powder in air at 850° C. for 2 hours, then crushing the calcined material to produce a complex oxide material, adding a proper amount of polyvinyl alcohol to the specified amounts of the complex oxide material and the ZnO powder, and mixing the powders using a ball-mill to produce a granulated powder. After press-compacting the granulated powder, the compacted body is sintered in air at 1190° C. for approximately 4 hours. The dimension of the ZnO element after sintering is ϕ50×25 t.

On the other hand, each of twenty-nine (29) kinds of powder of glass shown in table 2 (combination of individual metal oxides consist of ZnO: 5, 10, 13, 14, 15, 17, 20, and 25 wt. %, $SiO_2$: 15, 20, 26.2, 27.7, 28, 28.2, 29.2, 30, 40, and 44.2 wt. %, BaO=15, 20, 23, 24.2, 24.5, 25, 25.9, 26, 26.2, 26.5, 26.6, 27, 29.2, 30, and 35 wt. %, $ZnO_2$=1.0, 1.5, 3, 4,5, 5.5 wt. %, $Al_2O_3$filler=7, 10, 15, 22, 23, 25, 28, and 30 wt. %, CaO=0.4, 0.5, 0.8, 1.0, and 1.1 wt. %) is suspended in a carbithol solution of ethyl cellulose to form in a paste state, and the paste-state material is applied to the side surface of the above sintered body through spray method so that the thickness becomes 100~200 μm and then dried.

TABLE 2

| | COMPOSITIONS OF GLASS | | | | | | T.E.C. | S.T. | W.T. | CHARACTERISTICS OF ZnO ELEMENT N.L.C. | CHARACTERISTICS OF ZnO ELEMENT I.W.A. |
|---|---|---|---|---|---|---|---|---|---|---|---|
| | ZnO | $SiO_2$ | BaO | $ZrO_2$ | CaO | $Al_2O_3$ | (× $10^{-7}$/°C.) | (°C.) | (°C.) | (α) | (100 kA) |
| 1 | 20 | 39.2 | 30 | 3 | 0.8 | 7 | 74 | 750 | 800 | 28 | X |
| 2 | 17 | 39.2 | 30 | 3 | 0.8 | 10 | 70 | 780 | 850 | 30 | O |
| 3 | 15 | 29.2 | 27 | 3 | 0.8 | 25 | 70 | 790 | 850 | 28 | O |
| 4 | 15 | 26.2 | 25 | 3 | 0.8 | 30 | 68 | 795 | 860 | 30 | O |
| 5 | 15 | 26.2 | 20 | 3 | 0.8 | 35 | 50 | 800 | 860 | 29 | X |
| 6 | 14 | 29.2 | 25 | 1 | 0.8 | 30 | 77 | 795 | 850 | 28 | X |
| 7 | 14 | 29.2 | 24.5 | 1.5 | 0.8 | 30 | 72 | 795 | 850 | 28 | O |
| 8 | 14 | 28.2 | 24 | 3 | 0.8 | 30 | 70 | 800 | 850 | 29 | O |
| 9 | 13 | 28.2 | 24 | 4 | 0.8 | 30 | 65 | 800 | 850 | 30 | O |
| 10 | 13 | 28.2 | 23 | 5 | 0.8 | 30 | 55 | 805 | 860 | 28 | O |
| 11 | 13 | 27.7 | 23 | 5.5 | 0.8 | 30 | 45 | 810 | 860 | 29 | X |
| 12 | 20 | 31.2 | 15 | 3 | 0.8 | 30 | 70 | 770 | 840 | 28 | X |
| 13 | 15 | 31.2 | 20 | 3 | 0.8 | 30 | 68 | 780 | 850 | 30 | O |

TABLE 2-continued

| | COMPOSITIONS OF GLASS | | | | | | T.E.C. | S.T. | W.T. | CHARACTERISTICS OF ZnO ELEMENT N.L.C. | I.W.A. |
|---|---|---|---|---|---|---|---|---|---|---|---|
| | ZnO | $SiO_2$ | BaO | $ZrO_2$ | CaO | $Al_2O_3$ | ($\times 10^{-7}$/°C.) | (°C.) | (°C.) | (α) | (100 kA) |
| 14 | 15 | 31.2 | 25 | 3 | 0.8 | 25 | 68 | 780 | 850 | 29 | ○ |
| 15 | 14 | 29.2 | 30 | 3 | 0.8 | 23 | 70 | 780 | 850 | 30 | ○ |
| 16 | 14 | 24.2 | 35 | 3 | 0.8 | 23 | 70 | 780 | 850 | 29 | X |
| 17 | 20 | 15 | 29.2 | 5 | 0.8 | 30 | 75 | 750 | 800 | 27 | X |
| 18 | 14 | 20 | 24.2 | 3 | 0.8 | 28 | 70 | 790 | 850 | 30 | ○ |
| 19 | 14 | 30 | 24.2 | 3 | 0.8 | 28 | 70 | 795 | 850 | 28 | ○ |
| 20 | 10 | 40 | 24.2 | 3 | 0.8 | 22 | 65 | 800 | 860 | 29 | ○ |
| 21 | 10 | 44.2 | 20 | 3 | 0.8 | 22 | 65 | 860 | 920 | 28 | X |
| 22 | 5 | 30 | 29.2 | 5 | 0.8 | 30 | 45 | 850 | 900 | 30 | X |
| 23 | 10 | 30 | 29.2 | 5 | 0.8 | 25 | 60 | 795 | 860 | 29 | ○ |
| 24 | 25 | 30 | 24.2 | 5 | 0.8 | 15 | 65 | 745 | 780 | 28 | X |
| 25 | 14 | 28 | 26.6 | 3 | 0.4 | 28 | 70 | 790 | 850 | 29 | X |
| 26 | 14 | 28 | 26.5 | 3 | 0.5 | 28 | 70 | 790 | 850 | 30 | ○ |
| 27 | 14 | 28 | 26.2 | 3 | 0.8 | 28 | 70 | 790 | 850 | 28 | ○ |
| 28 | 14 | 28 | 26 | 3 | 1.0 | 28 | 70 | 790 | 850 | 29 | ○ |
| 29 | 14 | 28 | 25.9 | 3 | 1.1 | 28 | 70 | 788 | 850 | 29 | X |

In the above table 2, T.E.C., S.T., W.T., N.L.C., and I.W.A. represent thermal expansion coefficient, softening temperature, temperature of working, non-linear coefficient, and impulse withstanding ability, respectively.

The sintered body is heated up to 850° C. and kept for 2 hours, and then cooled down to room temperature at cooling rate of approximately 75° C./h. Electrodes are formed by melt-spraying Al on the top and bottom end surfaces of the sintered body to fabricate a ZnO element.

Table 2 shows twenty-nine (29) kinds of composition, thermal expansion coefficient, softening temperature, temperature of working, and non-linear coefficient and impulse withstanding ability of ZnO elements bake-attached with each of twenty-nine kinds of glass on the side surface by heat treatment. The impulse withstanding ability is evaluated by the presence or absence of damage (creepage short-circuit) of the ZnO element when an impulse current of 100 kA (8×20 μs) is conducted twice. In the table, the mark o indicates a normal case and the mark x indicates a damaged case.

The non-linear coefficients of the elements bake-attached with twenty-nine kinds of glass pastes are nearly 27 to 30 and not largely different. However, the elements bake-attached with the glass pastes No. 1, 5, 6, 11, 16, 17, 21, 22, 24, 25, and 29 are damaged by the impulse withstanding test of 100 kA.

The main cause of damage of the elements in the glass Nos. 6, 11, and 22 is separation in the interface between the ZnO element and the glass, and cracks in the glass due to the thermal expansion coefficient of the glass failing to match with the thermal expansion coefficient of the ZnO element (50 to $70\times10^{7}$/°C.); in the glass No. 21 is failure of the glass to bake-attach to the ZnO element because the softening temperature is too high; and in the glass No. 1, 5, 7, and 24 is cracks in the glass that occur because non-uniform layer is produced in the glass.

On the other hand, the main cause of damage of elements in the glass No. 12 is separation in the interface between the ZnO element and the glass due to sufficient wetness between the ZnO element and the glass; in the glass No. 16 is a low-resistivity portion due to non-uniform reaction of the glass with the ZnO element; and in the glasses No. 25 and No. 29 is the non-uniform resistivity distribution between the glass layer and the ZnO element.

From the above results, the optimum composition of the glass is preferably 10~20 wt. % ZnO, 20~40 wt. % $SiO_2$, 20~30 wt. % BaO, 1.5~5 wt. % $ZnO_2$, 10~30 wt. % $Al_2O_3$, 0.5~1.0 wt. % CaO.

Figure 2:
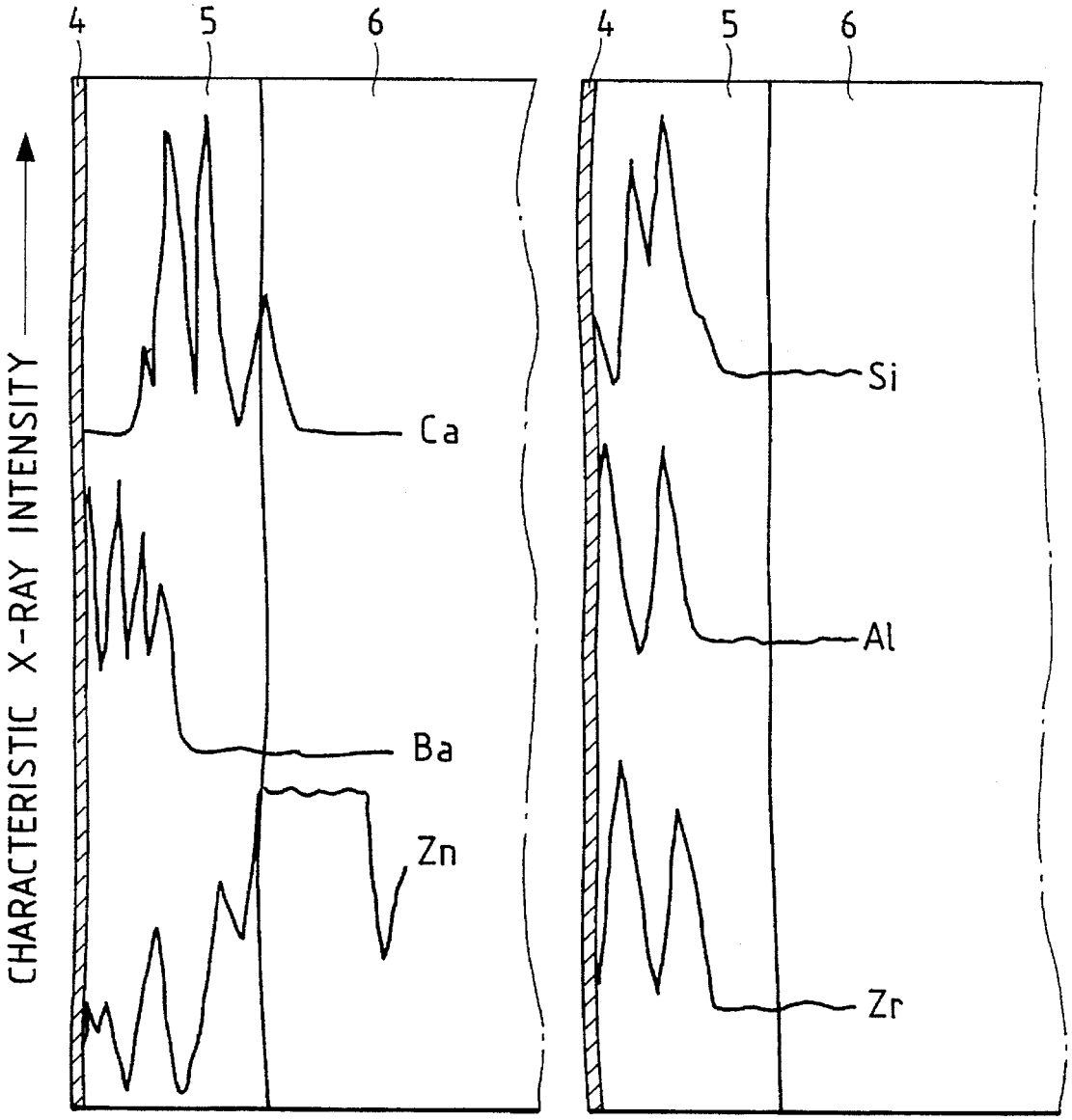
FIG. 2 is a schematic chart of characteristic X-ray intensity identifying metal elements near the glass reaction layer of a ZnO element in accordance with the present invention.

From scanning electron microscope observation of compositions in a cross-section near the side surface of a ZnO element bake-attached with the glass by heat treatment and the schematic chart of characteristic X-ray intensity (measuring apparatus: X-ray micro-analyzer) identifying metallic elements near the glass reaction layer shown in FIG. 2 (in which reference numbers 4, 5 and 6 represent a glass layer, glass reaction layer and ZnO element, respectively), it can be understood that the ZnO element 6 and the glass 4 are closely attached to each other through a glass reaction layer 5, and Ca deeply enters into and reacts with the ZnO element 6 from the glass layer 4 through the glass reaction layer 5 comparing with Ba, Si, Zr, Al. It is considered that this lessens the resistivity step between the glass reaction layer and the ZnO element. The balance of the resistances accompanied by the glass reaction layer substantially contributes to the improvement of the impulse withstanding ability.

Embodiment 3

The glass paste No. 3 shown in Table 2 is applied to the side surface of the ZnO element fabricated in the embodiment 2 and dried, and heated up to 850° C. kept for 2 hours, and then cooled down to room temperature at a cooling speed of near 70° C./h. The ZnO element obtained through in this manner is ground, cleaned, dried, and then dipped in an etching solution, having a ratio of nitric acid to water of 1:9 for 2 minutes. The index of acid resistance of glass is determined as the weight decrease before and after dipping. At that time, an element bake-attached with the conventionally used boron silicate zinc glass is also dipped in the etching solution for 2 minutes in order to test its acid resistivity for comparison.

The test result is shown in Table 3. The glass according to the present invention has a glass dissolving rate (weight decreasing rate) of nearly one-third that of the conventional one, and accordingly has better acid resistivity.

TABLE 3

| | GLASS ACCORDING TO THE PRESENT INVENTION | CONVENTIONAL GLASS (BORON SILICATE ZINC GLASS) |
|---|---|---|
| ACID RESISTIVITY (WEIGHT DECREASE $\mu g/cm^2$) | 6000~7000 | 30000~40000 |

Embodiment 4

The glass paste (No. 3 shown in Table 2) is applied to the side surface of the ZnO element fabricated in the embodiment 2 and dried, and heat-treated by changing the heating temperature in the heat treating process to 750°, 800°, 900°, 950°, 1000° C. Electrodes are formed in the element after heat treatment. The relationships between the temperature of heat treatment of the ZnO element and the attaching ability of glass to the ZnO element, and the impulse withstanding ability, are tested. The condition of the impulse is the same as in the embodiment 2. In the table, the mark o indicates a normal case and the mark x indicates a damaged case.

The result is shown in Table 4.

TABLE 4

| | H-TREAT TEMP (°C.) | | | | |
|---|---|---|---|---|---|
| ITEM | 750 | 800 | 900 | 950 | 1000 |
| ATTACH ABILITY | SEPARATION OF INTERFACE | GOOD | GOOD | GOOD | CRACK |
| IMPULSE WITHSTAND | x | o | o | o | x |

When the heating temperature in the heat treatment process is 750° and 1000° C., the attaching ability is bad and voids and cracks occur in the interface. Further, the impulse withstanding ability is bad. On the other hand, when the heat treating temperature is 800°~950° C., the attaching ability is good and the impulse withstanding ability is good. Therefore, the heating temperature in the heat treatment process is preferably 800°~950° C.

Embodiment 5

Figure 3:
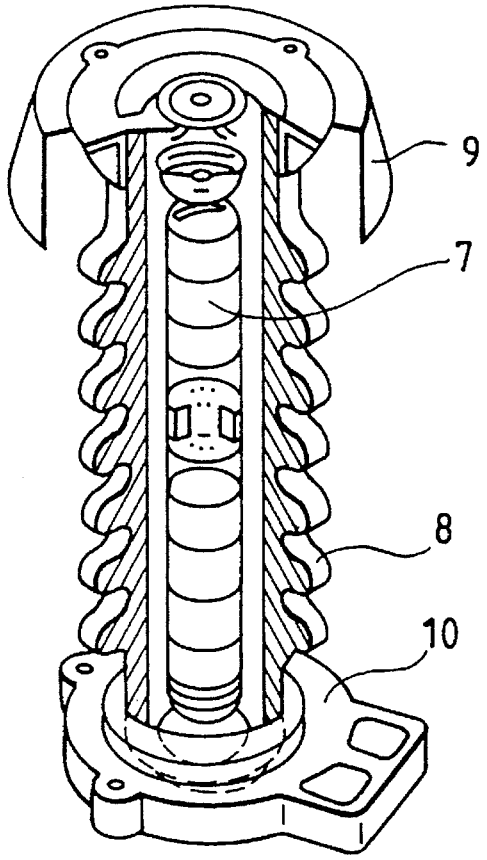
FIG. 3 is a view showing the structure of an arrester using voltage non-linear resistors in accordance with the present invention.

The glass paste (No. 3 shown in Table 2) is applied to the side surface of the ZnO element fabricated in the embodiment 2 and dried, and heat-treated at 850° C. for 2 hours. The voltage non-linear elements are contained in an insulator pipe to fabricate an insulator type arrester shown in FIG. 3 in which reference numbers 7, 8, 9 and 10 represent a voltage non-linear resistor, insulator, shield and an insulator base, respectively.

The same impulse withstanding ability test as in the embodiment 4 has been conducted using the arrester. After the test, the ZnO elements in the insulator pipe were inspected for presence and absence of penetrating damage. No penetrating damage was found.

According to the present invention, it is possible to obtain a voltage non-linear resistor having better impulse withstanding ability than the conventional one. As a result, the reliability and the stability of an electric power transmission/transforming system using the voltage nonlinear resistor are greatly improved.

What is claimed is:

1. A voltage non-linear resistor, comprising a sintered body having ZnO as a major constitution and containing Bi oxide as an additive, wherein a side surface of said sintered body is coated with a high melting-point crystallized glass containing $SiO_2$, $Al_2O_3$, ZnO, $ZnO_2$, BaO, and CaO as essential components, electrodes being formed on both ends of said sintered body.

2. A voltage non-linear resistor according to claim 1, wherein the ranges of composition for individual components of the coating glass in oxide base are 10~20 wt. % ZnO, 20~40 wt. % $SiO_2$, 10~30 wt. % $Al_2O_3$, 20~30 wt. % BaO, 1.5~5 wt. % $ZnO_2$, 0.5~1.0 wt. % CaO.

3. A voltage non-linear resistor according to claim 2, wherein the $Al_2O_3$ contained in the coating glass is a filler.

4. A method of fabricating a voltage non-linear resistor, comprising the steps of sintering a powder containing Bi oxide as the main component at a temperature of 1150°~1300° C. to form a sintered body, cooling down the sintered body below 300° C., applying the glass powder mentioned in claim 1 in a paste state to the side surface of the sintered body, then heating up the sintered body to 800°~950° C., keeping the state for longer than one hour to bake, and forming electrodes on the end of said sintered body.

5. An arrester constructed by containing the voltage non-linear resistor according to claim 1 in one of an insulator pipe and a tank.

6. A method of fabricating a voltage non-linear resistor, the method comprising the steps of sintering a powder containing Bi oxide as the main component at a temperature of 1150°~1300° C. to form a sintered body, cooling down the sintered body below 300° C., applying the glass powder mentioned in claim 2 in a paste state to the side surface of the sintered body, then heating up the sintered body to 800°~950° C., keeping the state for longer than one hour to bake, and forming electrodes on the end of said sintered body.

7. A method of fabricating a voltage non-linear resistor, the method comprising the steps of sintering a powder containing Bi oxide as the main component at a temperature of 1150°~1300° C. to form a sintered body., cooling down the sintered body below 300° C., applying the glass powder mentioned in claim 3 in a paste state to the side surface of the sintered body, then heating up the sintered body to 800°~950° C., keeping the state for longer than one hour to bake, and forming electrodes on the end of said sintered body.

8. An arrester constructed by containing the voltage non-linear resistor according to claim 2 in one of an insulator pipe and a tank.

9. An arrester constructed by containing the voltage non-linear resistor according to claim 3 in one of an insulator pipe and a tank.

10. An arrester constructed by containing the non-linear resistor fabricated according to the method of claim 4 in one of an insulator pipe and a tank.

* * * * *